US006582326B2

(12) United States Patent
Wu et al.

(10) Patent No.: US 6,582,326 B2
(45) **Date of Patent: *Jun. 24, 2003**

(54) GOLF BALL COMPRISING WATER RESISTANT POLYURETHANE ELASTOMERS AND METHODS OF MAKING THE SAME

(76) Inventors: Shenshen Wu, 334 Old Westport Rd., North Dartmouth, MA (US) 02747; David A. Bulpett, 45 E. Springfield St., Boston, MA (US) 02118; Kevin M. Harris, 65 Ryan St., New Bedford, MA (US) 02740; Mitchell E. Lutz, 55 Cedar St., Fairhaven, MA (US) 02719; Murali Rajagopalan, 11 Flagship Dr., South Dartmouth, MA (US) 02748

( * ) Notice: Subject to any disclaimer, the term of this patent is extended or adjusted under 35 U.S.C. 154(b) by 0 days.

This patent is subject to a terminal disclaimer.

(21) Appl. No.: 10/066,637

(22) Filed: Feb. 6, 2002

(65) Prior Publication Data

US 2002/0160863 A1 Oct. 31, 2002

Related U.S. Application Data

(63) Continuation of application No. 09/453,701, filed on Dec. 3, 1999, now Pat. No. 6,435,986.

(51) Int. Cl.[7] ..... A63B 37/12; A63B 37/14; A63B 37/00

(52) U.S. Cl. ..... 473/378; 473/351

(58) Field of Search ..... 473/351–378

(56) References Cited

U.S. PATENT DOCUMENTS

| | | | | |
|---|---|---|---|---|
| 3,147,324 A | | 9/1964 | Ward | 264/254 |
| 3,264,272 A | | 8/1966 | Rees | 260/78.5 |
| 3,454,280 A | | 7/1969 | Harrison et al. | 273/235 |
| 3,819,768 A | | 6/1974 | Molitor | 260/897 B |
| 3,940,145 A | | 2/1976 | Gentiluomo | 273/218 |
| 4,123,061 A | | 10/1978 | Dusbiber | 273/220 |
| 4,323,247 A | | 4/1982 | Keches et al. | 273/235 R |
| 4,431,193 A | | 2/1984 | Nesbitt | 273/235 R |
| 4,526,375 A | | 7/1985 | Nakade | 273/235 R |
| 4,884,814 A | | 12/1989 | Sullivan | 273/235 R |
| 4,911,451 A | | 3/1990 | Sullivan et al. | 273/235 R |
| 5,066,762 A | | 11/1991 | Ohbuchi et al. | 528/85 |
| 5,334,673 A | | 8/1994 | Wu | 273/235 R |
| 5,484,870 A | | 1/1996 | Wu | 528/28 |
| 5,688,595 A | | 11/1997 | Yamagishi et al. | 428/375 |
| 5,692,974 A | | 12/1997 | Wu et al. | 473/377 |
| 5,733,428 A | | 3/1998 | Calabria et al. | 264/134 |
| 5,800,286 A | | 9/1998 | Kakiuchi et al. | 473/365 |
| 5,820,488 A | | 10/1998 | Sullivan et al. | 473/374 |
| 5,820,491 A | | 10/1998 | Hatch et al. | 473/378 |
| 5,908,699 A | | 6/1999 | Kim | 428/408 |
| 5,989,136 A | | 11/1999 | Renard et al. | 473/376 |
| 6,150,462 A | | 11/2000 | Rajagopalan et al. | 525/74 |
| 6,190,268 B1 | | 2/2001 | Dewanjee | 473/370 |
| 6,210,294 B1 | * | 4/2001 | Wu | 473/372 |
| 6,371,870 B1 | * | 4/2002 | Calabria et al. | 473/370 |
| 6,435,986 B1 | * | 8/2002 | Wu et al. | 473/378 |

* cited by examiner

*Primary Examiner*—Paul T. Sewell
*Assistant Examiner*—Alvin A. Hunter, Jr.

(57) ABSTRACT

The invention provides a golf ball having a cover, intermediate layers and/or a core comprising in whole or in part of water resistant polyurethane elastomers. The polyurethane elastomers may be blended with conventional materials employed to form golf balls, covers and intermediate layers.

20 Claims, 5 Drawing Sheets

GOLF BALL COMPRISING WATER RESISTANT POLYURETHANE ELASTOMERS AND METHODS OF MAKING THE SAME

CROSS-REFERENCE TO RELATED APPLICATIONS

This application is a continuation of U.S. patent application Ser. No. 09/453,701, filed Dec. 3, 1999 now U.S. Pat. No. 6,435,986, now allowed, the entire disclosure of which is incorporated by reference herein.

FIELD OF THE INVENTION

The invention relates to golf balls and, more particularly, to golf balls having covers, intermediate layers and/or cores which comprise water resistant polyurethane elastomers and methods for making the same. Preferably, the cover of the golf ball is formed from a polyurethane to produce a water resistant cover.

BACKGROUND OF THE INVENTION

Golf ball covers are formed from a variety of materials, including balata and ionomer resins. Balata is a natural or synthetic trans-polyisoprene rubber. Balata covered balls are favored by the more highly skilled golfers because the softness of the cover allows the player to achieve higher spin rates sufficient to more precisely control ball direction and distance, particularly on shorter shots.

However, balata covered balls are easily damaged, and thus lack the durability required by the average golfer. Accordingly, alternative cover compositions have been developed in an attempt to provide balls with spin rates and a feel approaching those of balata covered balls, while also providing a golf ball with a higher durability and overall distance.

Ionomer resins have, to a large extent, replaced balata as a cover stock material. Chemically, ionomer resins are a copolymer of an olefin and an alpha, beta ethylenically-unsaturated carboxylic acid having 10–90% of the carboxylic acid groups neutralized by a metal ion. See U.S. Pat. No. 3,264,272. Commercially available ionomer resins include, for example, copolymers of ethylene and methacrylic or acrylic acid neutralized with metal salts. These are sold by E.I. DuPont de Nemours and Co. under the trademark "SURLYN®" and by the Exxon Corporation under the trademark "ESCOR®" and the trademark "IOTEK®". These ionomer resins are distinguished by the type of metal ion, the amount of acid, and the degree of neutralization.

U.S. Pat. Nos. 3,454,280, 3,819,768, 4,323,247, 4,526,375, 4,884,814, and 4,911,451 all relate to the use of SURLYN®-type compositions in golf ball covers. However, while SURLYN® covered golf balls as described in the preceding patents possess virtually cutproof covers, they have inferior spin and feel properties as compared to balata covered balls.

Polyurethanes and polyureas have also been recognized as useful materials for golf ball covers since as early as about 1960. U.S. Pat. No. 3,147,324, filed Oct. 20, 1960, is directed to a method of making a golf ball having a polyurethane cover. The curing agents disclosed are diamines, polyols or air moisture. The disclosed polyurethane covered golf balls are durable, while at the same time maintaining the "feel" of a balata ball.

Since 1960, various companies have investigated the usefulness of polyurethane and polyurea as golf ball cover materials. U.S. Pat. No. 4,123,061 issued Oct. 31, 1978 teaches that a golf ball can be made from a polyurethane prepolymer of polyether and a curing agent, such as a trifunctional polyol, a tetrafunctional polyol or a diamine. U.S. Pat. No. 5,334,673 issued Aug. 2, 1994 discloses the use of two categories of polyurethane available on the market, i.e., thermoset and thermoplastic polyurethanes for forming golf ball covers, and in particular, thermoset polyurethane covered golf balls made from a composition of polyurethane prepolymer and a slow-reacting amine curing agent and/or a difunctional glycol. U.S. Pat. No. 5,484,870 issued Jan. 16, 1996 teaches that golf ball covers may be prepared from polyurea compositions which are prepared by combining an organic isocyanate having at least two isocyanate functional groups with an organic amine curing agent.

The first commercially successful polyurethane covered golf ball was Titleist's PROFESSIONAL golf ball in 1993. The principal reason for the delay in bringing polyurethane composition golf ball covers on the market was that it was a daunting engineering task to apply a covering of polyurethane composition to a golf ball core to form a golf ball cover having a uniform thickness.

In particular, the difficulty resided in centering a golf ball core in an amount of polyurethane that was sufficiently cured to keep the core centered while at the same time being insufficiently cured so that the cover material could be molded around the core. Resolution of this problem thus enabled production of the aforesaid PROFESSIONAL polyurethane covered golf ball to commence in 1993.

Unlike SURLYN® covered golf balls, polyurethane golf ball covers can be formulated to possess the soft "feel" of balata covered golf balls. Further, the polyols commonly used in the preparation of cast polyurethane elastomers are polyether, polycarbonate, polycaprolactone and polyester polyols. Polyurethane elastomers formed using such polyols are highly susceptible to changes in their physical properties due to absorption of moisture, with those polyurethane elastomers formed using polyether polyols being slightly more stable than polyurethane elastomers formed using polyester polyols. The polyether polyols which exhibit the greatest resistance to absorption of moisture are those based on polytetramethyleneether glycol (PTMEG) and poly (oxypropylene)glycol. U.S. Pat. No 5,820,488 relates to the use of a moisture barrier surrounding the core and being located between the cover and the core in order to reduce absorption of water by the ball during storage. However, there still remains a need for polyurethane materials which are resistant to absorption of moisture and which are suitable for forming a golf ball.

SUMMARY OF THE INVENTION

The invention is directed to a golf ball having at least one layer, formed of a water resistant polyurethane elastomer. In particular, the invention relates to a golf ball having at least one layer, such layer(s) being formed of a water resistant polyurethane. Thus, the water resistant polyurethane elastomer should be the reaction product of at least one polyisocyanate, at least one polyol and at least one curing agent, wherein said polyol and/or said curing agent is based on a hydrophobic backbone.

The use of such polyurethane elastomers in the golf ball cover leads to a golf ball which demonstrates improved stability with respect to its resistance to the absorption of moisture. Conventional polyurethane elastomers are more prone to absorption of moisture than are polyurethane elastomers based on hydrophobic backbones, such as the polyurethane elastomers of the present invention, which are based on hydrocarbon and hydroxy-terminated polybutadiene polyols. The physical properties of polyurethane elastomers based on polyether and polyester polyols are therefore affected to a greater degree by changes in the moisture content of their surroundings and also by the temperature. The water resistant polyurethane elastomers used in forming the golf balls of the present invention do not absorb moisture to the same extent as do conventional polyether and polyester polyol based polyurethanes. Thus, the improved performance characteristics of the golf balls of the present invention demonstrate a distinct benefit to the golfer by providing a golf ball which exhibits consistent behavior over a wide range of environmental conditions.

While water resistant polyurethanes will generally be used in forming some or all of the cover of the golf ball of the invention, they may also or alternatively comprise one or more intermediate layer(s) located between the cover and the core, or the core itself. The water resistant polyurethane may comprise anywhere from 1 to 100% by weight of the intermediate layer(s), core and/or the cover of the golf ball.

A "cover" or a "core" as these terms are used herein includes a structure comprising either a single layer or one with two or more layers. As used herein, a core described as comprising a single layer means a unitary or "one-piece" core. The "layer" thus includes the entire core from the center of the core to its outer periphery. A core, whether formed from a single layer or from two or more layers may serve as a center for a wound ball. An intermediate layer may be incorporated, for example, with a single layer or multilayer cover, with a single layer or multilayer core, with both a single layer cover and core, or with both a multilayer cover and a multilayer core. A layer may additionally be composed of a tensioned elastomeric material, i.e., known as a wound layer. Intermediate layers of the type described above are sometimes referred to in the art, and, thus, herein as well, as an inner cover layer, as an outer core layer, or as a mantle layer. A liquid center ball as described herein includes liquid and rubber centered golf balls, and may be incorporated, for example, in solid as well as wound golf balls.

The invention is directed in a first embodiment to one-piece golf balls comprised of a water resistant polyurethane elastomer, as well as to other embodiments involving two-piece and multi-component, e.g., three-piece, golf balls comprising at least one cover layer and a core, wherein at least one cover layer comprises a water resistant polyurethane elastomer, as well as multi-component golf balls comprising cores or covers having two or more layers, wherein at least one such layer(s) is formed of water resistant polyurethane elastomers.

More particularly, the present invention is directed, in a first embodiment, towards a golf ball comprising at least a cover and at least one core layer wherein the cover is formed from a composition comprising at least one water resistant polyurethane elastomer.

The present invention is further directed in a second embodiment towards a golf ball comprising a cover, a core and at least one intermediate layer interposed between the cover and an outermost core layer, wherein the intermediate layer is formed from a composition comprising at least one water resistant polyurethane elastomer.

The present invention is yet further directed in a third embodiment towards a golf ball comprising a cover, a core and at least one intermediate layer interposed between the cover and the core, wherein the outermost cover layer and at least one intermediate layer are both formed from a composition comprising at least one water resistant polyurethane elastomer.

The present invention is yet further directed in a fourth embodiment towards a golf ball comprising a cover, a core and at least one intermediate layer interposed between the cover and the core, wherein the core is formed from a composition comprising at least one water resistant polyurethane elastomer.

In the golf ball cover embodiment of the present invention, the water resistant polyurethane elastomer preferably comprises from 1 to 100% by weight of the cover, with the remainder of the cover, if any, being comprised of one or more compatible, resilient polymers such as would be known to one of ordinary skill in the art.

Preferably, the water resistant polyurethane elastomers used in forming the golf balls of the present invention can be formed in accordance with the teachings described in U.S. Pat. Nos. 5,334,673 and 5,733,428, described above.

DESCRIPTION OF THE PREFERRED EMBODIMENTS

Figure 1:
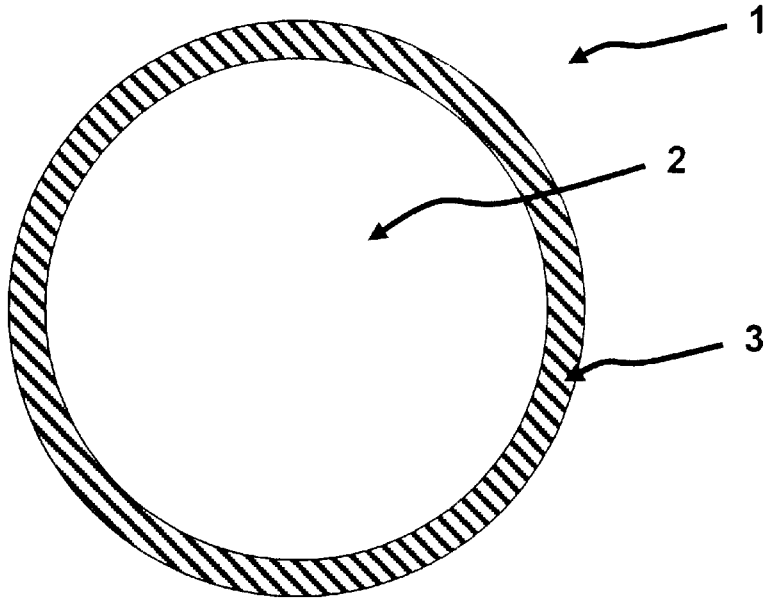
FIG. 1 is a cross-sectional view of a two-piece golf ball wherein the cover is formed from a composition comprising at least one water resistant polyurethane elastomer.

Broadly, the present invention contemplates a golf ball comprising a water resistant polyurethane elastomer. The ball may be a one-piece ball formed from a homogeneous mass consisting entirely of such materials, or including blends of conventional golf ball cover materials, such as those discussed hereinbelow, with a water resistant polyurethane elastomer.

One-piece balls in accordance with the present invention are quite durable, but do not provide great distance because of relatively high spin and low velocity.

A more preferred aspect of the present invention comprises two-piece, multi-component and/or wound balls having cores, liquid centers, intermediate layers and/or covers comprising a water resistant polyurethane elastomer of the type disclosed herein.

Water Resistant Polyurethane Elastomers

The water resistant polyurethane elastomers suitable for use in the invention are a product of a reaction between at least one polyurethane prepolymer and at least one curing agent. The polyurethane prepolymer is a product formed by a reaction between at least one poly-isocyanate and at least one polyol, the polyol being based on a hydrophobic backbone, such as hydrocarbon polyols, hydroxy-terminated polybutadiene polyols, polyethers, polycaprolactones and polyesters. As is well known in the art, a catalyst may be employed to promote the reaction between the curing agent and the isocyanate and polyol.

Suitable diisocyanates which can be used include, without limitation, toluene diisocyanate (TDI); 4,4'-diphenylmethane diisocyanate (MDI); polymeric MDI; carbodiimide-modified MDI; 3,3'-dimethyldiphenyl-4,4'diisocyanate (TODI); naphthalene diisocyanate (NDI); para-phenylene diisocyanate (PPDI); xylene diisocyanate (XDI); para-tetramethylxylene diisocyanate (p-TMXDI); meta-tetramethylxylene diisocyanate (m-TMXDI); ethylene diisocyanate; propylene-1,2-diisocyanate; tetramethylene-1,4-diisocyanate; cyclohexyl diisocyanate; 1,6-hexamethylene-diisocyanate (HDI); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanato-methylcyclohexane; isophorone diisocyanate (IPDI); methyl cyclohexylene diisocyanate; triisocyanate of HDI; triisocyanate of 2,2,4-trimethyl-1,6-hexane diisocyanate (TMDI); triisocyanate of 2,4,4-trimethyl-1,6-hexane diisocyanate (TMDI); 4,4'-dicyclohexylmethane diisocyanate (HMDI); trimethylhexamethylene diisocyanate (p-TMXDI) and mixtures thereof.

Suitable polyols which are appropriate for use in this invention include without limitation saturated and unsaturated hydrocarbon polyols; hydroxy-terminated liquid isoprene rubber (LIR); hydroxy-terminated polybutadiene polyol; polytetramethylene ether glycol (PTMEG); poly (oxypropylene)glycol; polyethylene adipate glycol; polyethylene propylene adipate glycol; polybutylene adipate glycol; diethylene glycol initiated polycaprolactone; 1,4-butanediol initiated polycaprolactone; 1,6-hexanediol initiated polycaprolactone; trimethylol propane initiated polycaprolactone; neopentyl glycol initiated polycaprolactone; polytetramethylene ether glycol (PTMEG) initiated polycaprolactone and mixtures thereof.

Suitable curatives include without limitation 1,4-butanediol; 1,3-butanediol; 2,3-butanediol; 2,3-dimethyl-2,3-butanediol; propylene glycol, dipropylene glycol; polypropylene glycol; ethylene glycol; diethylene glycol; polyethylene glycol; resorcinol-di (beta-hydroxyethyl) ether and its derivatives; hydroquinone-di(beta-hydroxyethyl) ether and its derivatives; 2-propanol-1,1'-phenylaminobis; tetrahydroxypropylene ethylene diamine; trimethylolpropane; 4,4'-methylenebis(2-chloroaniline); 3,5-dimethylthio-2,4-toluenediamine; 3,5-dimethylthio-2,6-toluenediamine; 4,4'-methylenebis(2-ethylaniline); 4,4'-bis-(sec-butylamino)-diphenylmethane; 1,3-bis-(2-hydroxyethoxy) benzene; 1,3-bis-[2-(2-hydroxyethoxy) ethoxy]benzene; 1,3-bis-{2-[2-(2-hydroxyethoxy) ethoxy]ethoxy}benzene; 1,4-bis-(sec-butylamino) benzene; 1,2-bis-(sec-butylamino) benzene; 3,5-diethyltoluene-2,4-diamine; 3,5-diethyltoluene-2,6-diamine; tetra-(2-hydroxypropyl)-ethylenediamine; N,N'-dialkyldiamino diphenyl methane; trimethyleneglycol-di-p-aminobenzoate; polytetramethyleneoxide-di-p-aminobenzoate; 4,4'-methylene bis-(3-chloro-2,6-diethylaniline); 1,4-cyclo- hexyldimethylol; 2-methylpentamethylene-diamine; isomers and mixtures of diaminocyclohexane; isomers and mixtures of cyclohexane bis(methylamine); polytetramethylene ether glycol; isomers and mixtures of cyclohexyldimethylol; triisopropanolamine; diethylene triamine; triethylene tetramine; tetraethylene pentamine; propylene diamine; 1,3-diaminopropane; dimethylamino propylamine; diethylamino propylamine; imido-bis-propylamine; monoethanolamine; diethanolamine; triethanolamine; monoisopropanolamine and diisopropanolamine. The most preferred curatives are 3,5-dimethylthio-2,4-toluenediamine,3,5-dimethylthio-2,6-toluenediamine and 4,4'-bis-(sec-butylamino)-diphenylmethane.

Suitable catalysts include, but are not limited to bismuth catalyst, oleic acid, triethylenediamine (DABCO®-33LV), di-butyltin dilaurate (DABCO®-T12) and acetic acid. The most preferred catalyst is triethylenediamine (DABCO®-33LV). DABCO® products are sold by Air Products.

Cover and Intermediate Layer Compositions

Preferably, the polyurethane elastomers of the present invention comprise from about 1 to about 100%, more preferably from about 10 to about 75% of the cover composition and/or the intermediate layer composition. About 90 to about 10%, more preferably from about 90 to about 25% of the cover and/or the intermediate layer composition is comprised of one or more other polymers and/or other materials as described below. Such polymers include, but are not limited to polyurethane/polyurea ionomers, polyurethanes or polyureas and epoxy resins. Unless otherwise stated herein, all percentages are given in percent by weight of the total composition of the golf ball layer in question.

Other suitable materials which may be combined with the water resistant polyurethane elastomers in forming the cover and/or intermediate layer(s)of the golf balls of the invention include ionic or non-ionic polyurethanes or polyureas, siloxanes and epoxy resins or blends of these materials. For example, the cover and/or intermediate layer may be formed from a blend of at least one water resistant polyurethane elastomer with anionic and cationic urethanes/polyurethanes, urethane epoxies, polyureas and ionic polyureas and blends thereof. Examples of suitable urethane ionomers are disclosed in U.S. Pat. No. 5,692,974 entitled "Golf Ball Covers", the disclosure of which is hereby incorporated by reference in its entirety. Other examples of suitable polyurethanes are described in U.S. Pat. No. 5,334,673. Examples of appropriate polyureas are discussed in U.S. Pat. No. 5,484,870 and examples of suitable polyurethanes cured with epoxy group containing curing agents are disclosed in co-pending U.S. patent application Ser. No. 08/962,699, filed Nov. 3, 1997, which is a file wrapper continuation of U.S. application Ser. No. 08/482,524 filed Jun. 7, 1995. These are all incorporated herein by reference.

A variety of conventional components can be added to the cover compositions of the present invention. These include, but are not limited to, white pigment such as $TiO_2$, ZnO, optical brighteners, surfactants, processing aids, density-controlling fillers, UV stabilizers and light stabilizers and foaming agents. Addition of UV absorbers and light stabilizers to the water resistant polyurethane elastomers may help to maintain the tensile strength and elongation of the polyurethane elastomers. Suitable UV absorbers and light stabilizers include TINUVIN™ 328, TINUVIN™ 213, TINUVIN™ 765, TINUVIN™ 770 and TINUVIN™ 622. The preferred UV absorber is TINUVIN™ 328, and the preferred light stabilizer is TINUVIN™ 765. TINUVIN™ products are available from Ciba-Geigy. Dyes, as well as optical brighteners and fluorescent pigments may also be included in the golf ball covers produced with polymers formed according to the present invention. Such additional ingredients may be added in any amounts that will achieve their desired purpose.

Other conventional ingredients, e.g., density-controlling fillers, ceramics and glass spheres are well known to the person of ordinary skill in the art and may be included in cover and intermediate layer blends of the present invention in amounts effective to achieve their known purpose.

An optional filler component may be chosen to impart additional density to blends of the previously described components. The selection of such filler(s) is dependent upon the type of golf ball desired (i.e., one-piece, two-piece multi-component or wound), as will be more fully detailed below. Generally, the filler will be inorganic, having a density greater than about 1.5 g/cc, preferably greater than 4 g/cc, and will be present in amounts between 5 and 65 weight percent based on the total weight of the polymer components comprising the layer(s) in question. Examples of useful fillers include zinc oxide, barium sulfate, calcium oxide, calcium carbonate and silica, as well as the other well known corresponding salts and oxides thereof.

Golf Ball Cores

A representative elastomer base composition for forming a golf ball core prepared in accordance with the present invention comprises a base rubber, a crosslinking agent and a filler. The base rubber typically includes natural or synthetic rubbers. A preferred base rubber is 1,4-polybutadiene having a cis-structure of at least 40%. Natural rubber, polyisoprene rubber and/or styrene-butadiene rubber may be optionally added to the 1,4-polybutadiene. Crosslinking agents include metal salts of unsaturated fatty acids, such as zinc or magnesium salts of acrylic or methacrylic acid. The filler typically includes materials such as zinc oxide, barium sulfate, silica, calcium carbonate, metal, glass spheres and the like. The cores of golf balls formed according to the invention may be solid, liquid or hollow, fluid-filled or semi-solid filled, one-piece or multi-component cores, or they may, if desired, be wound.

Golf Ball Manufacture

The water resistant polyurethane elastomers of the invention can be used to form any type of golf ball, i.e., one-piece, two-piece, wound or multi-component. In particular, wound liquid center golf balls comprising a cover surrounding a core are within the scope of the present invention, as are wound golf balls, in which a fluid-filled, semi-solid, or solid core is surrounded by a tensioned elastomeric material. The term "fluid" as used herein refers to a liquid or a gas. The term "semi-solid" as used herein refers to a paste, a gel or the like. The term "solid cores" as used herein refers not only to one piece cores but also to those cores having a separate solid layer beneath the cover and above the core as disclosed in U.S. Pat. No. 4,431,193 (the disclosure of which is incorporated herein), and other multilayer and/or non-wound cores. Any type of golf ball core can be used in the golf balls of the present invention. Preferred cores, however, include some amount of cis-polybutadiene. The subject polymers may also be used in golf balls having multiple covers and/or multiple cores.

One method for forming a polyurethane cover on a golf ball core is disclosed in U.S. Pat. No. 5,733,428, which method is incorporated by reference herein. This method relates to the use of thermosetting material as the golf ball cover.

The present invention can be used in forming golf balls of any desired size. "The Rules of Golf" by the USGA dictates that the size of a competition golf ball be larger than 1.680 inches in diameter, golf balls of any size can be used for leisure golf play. The preferred diameter of the golf balls is from about 1.680 inches to about 1.800 inches. The more preferred diameter is from about 1.680 inches to about 1.760 inches. A diameter of from about 1.680 inches to about 1.740 inches is most preferred, however diameters anywhere in the range of from 1.70 to about 1.95 inches can be used. Oversize golf balls with diameters above about 1.760 inches to as big as 2.75 inches are also within the scope of the present invention.

Preferred embodiments of the balls of the invention are shown in FIGS. 1–5. In FIG. 1, the golf ball 1 comprises a core 2 of conventional materials and a cover 3 comprising at least one water resistant polyurethane elastomer.

Figure 2:
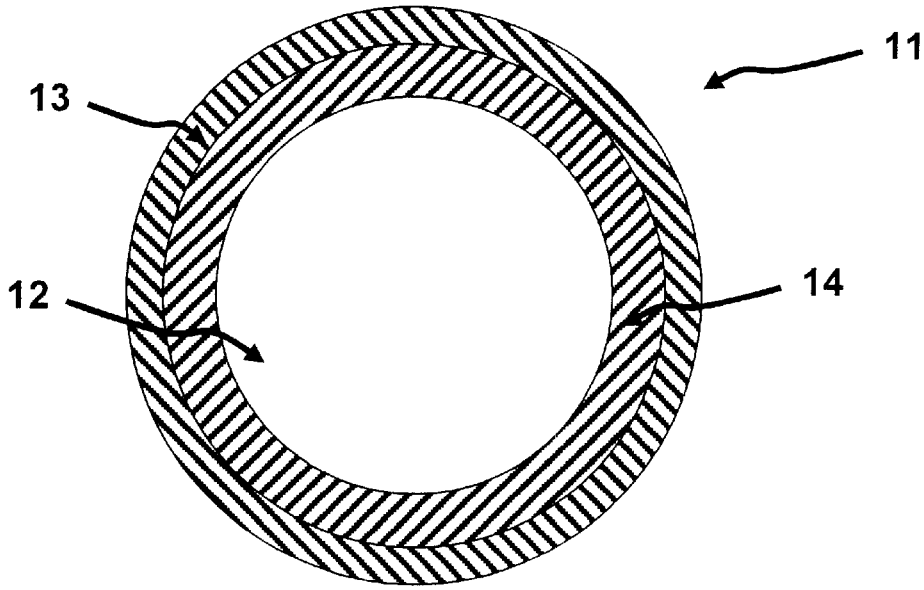
FIG. 2 is a cross-sectional view of a multi-component golf ball wherein at least one intermediate layer is formed from a composition comprising at least one water resistant polyurethane elastomer.

FIG. 2 illustrates a multi-piece golf ball 11, which comprises a cover 13, at least one intermediate layer 14 and a core 12. The intermediate layer is comprised of at least one water resistant polyurethane elastomer.

Figure 3:
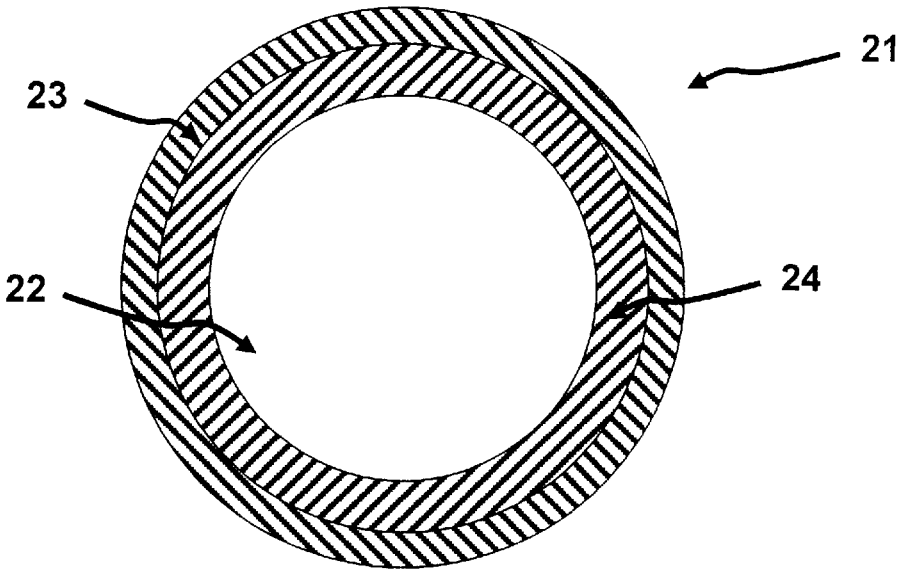
FIG. 3 is a cross-sectional view of a multi-component golf ball wherein the cover and an intermediate layer are formed from a composition comprising at least one water resistant polyurethane.

The golf ball 21 of FIG. 3 has a core 22 made of conventional materials, and at least one intermediate layer 24 and 23 comprising at least one water resistant polyurethane elastomer.

Figure 4:
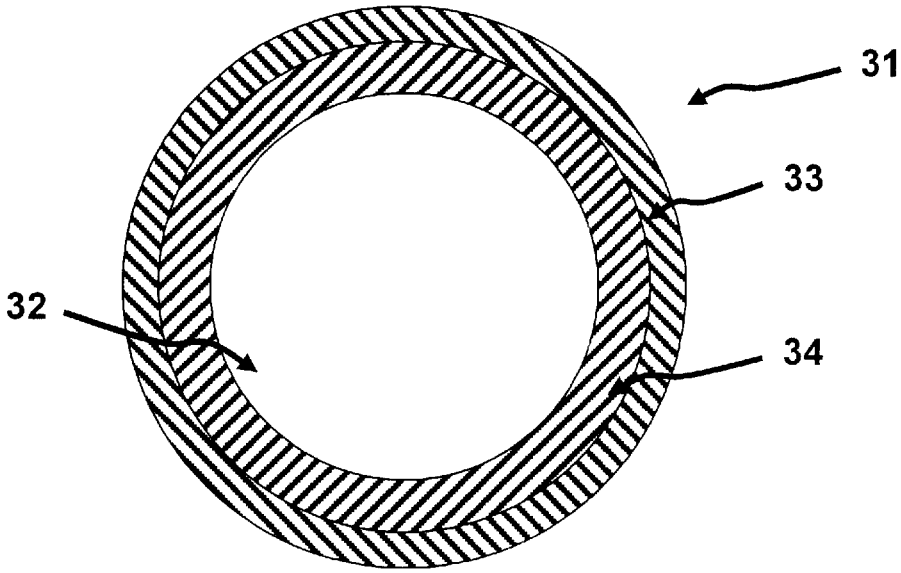
FIG. 4 is a cross-sectional view of a wound golf ball wherein the core is surrounded by a tensioned elastomeric material and the cover is formed from a composition comprising at least one water resistant polyurethane elastomer.

The wound golf ball 31 of FIG. 4 has a core 32 made of conventional materials, an intermediate layer comprising a tensioned elastomeric material 34 and cover 33 comprising at least one water resistant polyurethane elastomer.

Figure 5:
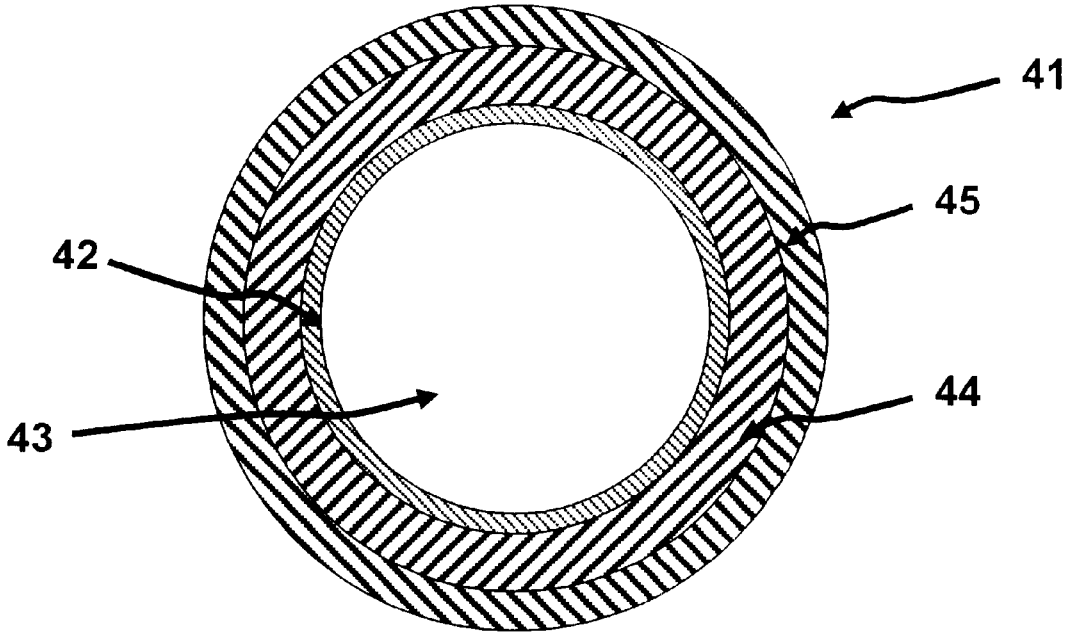
FIG. 5 is a cross-sectional view of a liquid center wound golf ball wherein the liquid core is surrounded by a tensioned elastomeric material and the cover is formed from a composition comprising at least one water resistant polyurethane elastomer.

The wound, liquid center golf ball 41 of FIG. 5 has a hollow spherical core shell 42 with its hollow interior filled with a liquid 43, a thread rubber layer comprising a tensioned elastomeric material 44 and a cover 45 comprising at least one water resistant polyurethane elastomer.

The invention will now be illustrated by the following examples. The examples are not intended to be limiting of the scope of the present invention. In conjunction with the general and detailed descriptions above, the examples provide further understanding of the present invention. Parts are by weight unless otherwise indicated.

EXAMPLE

Moisture resistance of the golf balls of the present invention was measured compared to that of a control. The ingredients of the formulation according to this example were as follows:

HB5: The reaction product of MDI, di-hydroxy terminated polybutadiene prepolymer and Unilink 4200.

The covers were molded on 1.580 inch wound balls, and were finished with a conventional coating. The balls were incubated in a 50% relative humidity and 72° F. environmental chamber for one week, and then weighed and measured. These conditioned balls were subjected to a 100% relative humidity and 72° F. environmental chamber. Weight and size changes were monitored over a period of 7 weeks.

Figure 6:
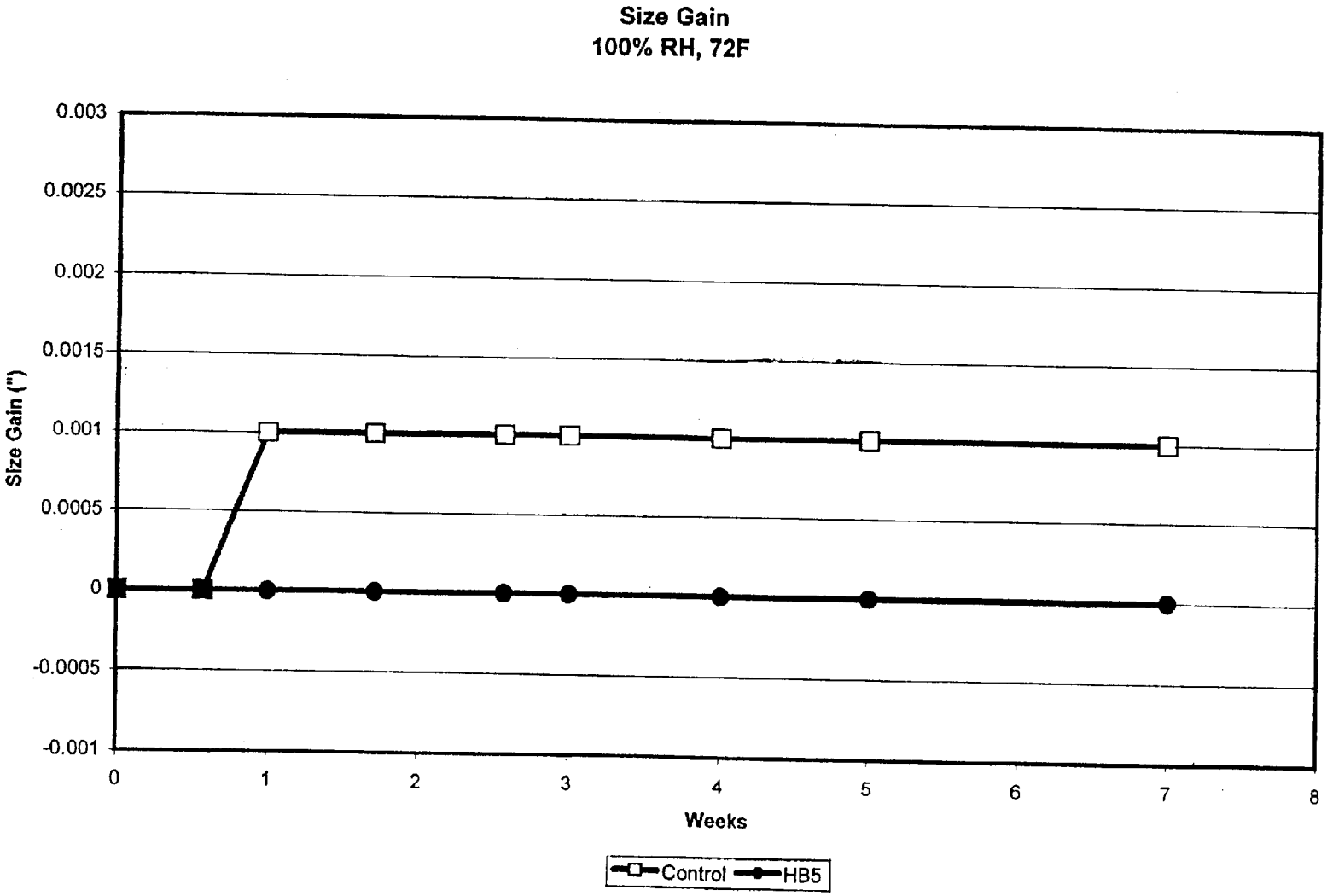
FIG. 6 is a graphical representation of the weight changes of golf balls subjected to controlled temperature and humidity over a specified amount of time.
Figure 7:
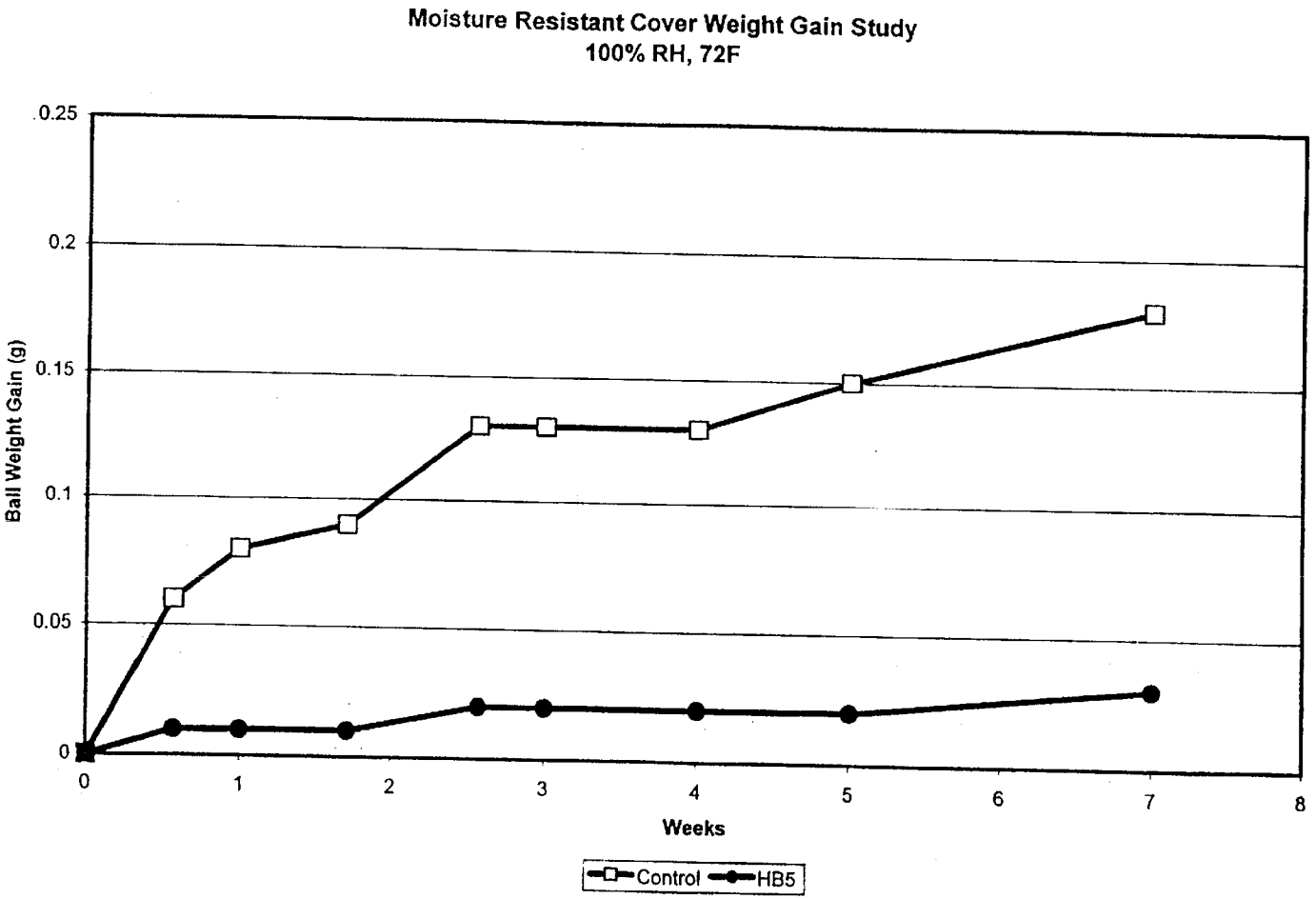
FIG. 7 is a graphical representation of the size changes of golf balls subjected to controlled temperature and humidity over a specified amount of time.

The results of the tests are tabulated below and are illustrated graphically in FIGS. 6 and 7.

Weight and Size Gain of the Urethane Covered Balls with Time 100% RH, 72F

| | Weight Gain (g) | | | | | | | |
|---|---|---|---|---|---|---|---|---|
| Ball Type/Time | 4 days | 1 week | 1 week 5 days | 2 weeks 4 days | 3 weeks | 4 weeks | 5 weeks | 7 weeks |
| Control | +0.06 | +0.08 | +0.09 | +0.13 | +0.13 | +0.13 | +0.15 | +0.18 |
| HB5* | +0.01 | +0.01 | +0.01 | +0.02 | +0.02 | +0.02 | +0.02 | +0.03 |

*HB5: MDI/Di-hydroxy terminated polybutadiene prepolymer reacted with Unilink 4200 curative.

| | Size Gain (inches) | | | | | | | |
|---|---|---|---|---|---|---|---|---|
| Ball Type/Time | 4 days | 1 week | 1 week 5 days | 2 weeks 4 days | 3 weeks | 4 weeks | 5 weeks | 7 weeks |
| Control | 0 | +0.001 | +0.001 | +0.001 | +0.001 | +0.001 | +0.001 | +0.001 |
| HB5 | 0 | 0 | 0 | 0 | 0 | 0 | 0 | 0 |

What is claimed is:

1. A golf ball comprising a core and a cover, wherein the cover is formed from a composition comprising a water resistant polyurethane elastomer, and wherein the cover has a thickness of from about 0.02 inch to about 0.35 inch, a hardness of at least about 40 Shore D, and a flexural modulus of at least about 500 psi.

2. The golf ball of claim 1, wherein the composition further comprises a polymer present in an amount from about 90 percent to about 10 percent by weight of the composition.

3. The golf ball of claim 2, wherein the polymer comprises polyurethane ionomers, polyurea ionomers, polyurethanes, polyureas, epoxy resins, or a combination thereof.

4. The golf ball of claim 1, wherein the cover has a thickness of from about 0.02 inch to about 0.125 inch.

5. The golf ball of claim 1, wherein the ball further comprises an intermediate layer disposed between the core and the cover.

6. The golf ball of claim 5, wherein the intermediate layer is formed from a composition comprising a water resistant polyurethane elastomer.

7. The golf ball of claim 6, wherein the composition further comprises a polymer present in an amount from about 90 percent to about 10 percent by weight of the composition.

8. The golf ball of claim 7, wherein the polymer comprises polyurethane ionomers, polyurea jonomers, polyurethanes, polyureas, epoxy resins, or a combination thereof.

9. The golf ball of claim 6, wherein the intermediate layer has a hardness of about 40 Shore A or greater and a flexural modulus of about 500 psi or greater.

10. The golf ball of claim 1, wherein the water resistant polyurethane elastomer is a reaction product of at least one poly-isocyanate, at least one curing agent and at least one polyol, wherein said polyol is based on a hydrophobic backbone.

11. The golf ball of claim 10 wherein the poly-isocyanate is selected from the group consisting of toluene diisocyanate; 4,4'-diphenylmethane diisocyanate; polymeric 4,4'-diphenylmethane diisocyanate; carbodiimide-modified diphenylmethane diisocyanate; 3,3'-dimethyldiphenyl-4,4'diisocyanate; naphthalene diisocyanate; para-phenylene diisocyanate; xylene diisocyanate; para-tetramethylxylene diisocyanate; meta-tetramethyixylene diisocyanate; ethylene diisocyanate; propylene-1,2-diisocyanate; tetramethylene-1,4-diisocyanate; cyclohexyl diisocyanate; 1,6-hexamethylene-diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanato-methylcyclohexane; isophorone diisocyanate; methyl cyclohexylene diisocyanate; triisocyanate of 1,6-hexamethylene-diisocyanate; triisocyanate of 2,2,4-trimethyl-1,6-hexane diisocyanate; triisocyanate of 2,4,4-trimethyl-1,6-hexane diisocyanate; 4,4'-dicyclohexylmethane diisocyanate; trimethyl-hexamethylene diisocyanate, and mixtures thereof.

12. The golf ball of claim 10, wherein the polyol is selected from the group consisting of saturated and unsaturated hydrocarbon polyols; hydroxy-terminated liquid isoprene rubber; hydroxy-terminated polybutadiene polyol; polytetramethylene ether glycol; poly(oxypropylene) glycol; polyethylene adipate glycol; polyethylene propylene adipate glycol; polybutylene adipate glycol; diethylene glycol initiated polycaprolactone; 1,4-butanediol initiated polycaprolactone; 1,6-hexanediol initiated polycaprolactone; trimethylol propane initiated polycaprolactone; neopentyl glycol initiated polycaprolactone; polytetramethylene ether glycol initiated polycaprolactone, and mixtures thereof.

13. The golf ball of claim 10, wherein the curing agent is selected from the group consisting of 1,4-butanediol; 1,3-butanediol; 2,3-butanediol; 2,3-dimethyl-2,3-butanediol; propylene glycol, dipropylene glycol; polypropylene glycol; ethylene glycol; diethylene glycol; polyethylene glycol; resorcinol-di(beta-hydroxyethyl) ether and its derivatives; hydroquinone-di(beta-hydroxyethyl) ether and its derivatives; 2-propanol-1,1'-phenylaminobis; tetrahydroxypropylene ethylene diamine; trimethyloipropane; 4,4'-methylenebis(2-chloroaniline); 3,5-dimethylthio-2,4-toluenediamine; 3,5-dimethylthio-2,6-toluenediamine; 4,4'-methylenebis(2-ethylaniline); 4,4'-bis-(sec-butylamino)-diphenylmethane; 1,3 -bis-(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-bis-(sec-butylamino) benzene; 1,2-bis-(sec-butylamino)benzene; 3,5-diethyltoluene-2,4-diamine; 3,5 -diethyltoluene-2,6-diamine; tetra-(2-hydroxypropyl)-ethylenediamine; N,N'-dialkyldiamino diphenyl methane; trimethyleneglycol-di-p-aminobenzoate; polytetramethyleneoxide-di-p-aminobenzoate; 4,4'-methylene-bis-(3-chloro-2,6-diethylaniline); isomers and mixtures of cyclohexyldimethylol; isomers and mixtures of cyclohexane bis(methylamine); polytetramethylene ether glycol; 2-methylpentamethylene-diamine; isomers and mixtures of diaminocyclohexane; triisopropanolamine; diethylene triamine; triethylene tetramine; tetraethylene pentamine; propylene diamine; 1,3-diaminopropane; dimethylamino propylamine; diethylamino propylamine; imido-bis-propylamine; monoethanolamine; diethanolamine; triethanolamine; monoisopropanolamine; diisopropanolamine and mixtures thereof.

14. The golf ball of claim 10, wherein the polyol is selected from the group consisting of saturated and unsaturated hydrocarbon polyols; hydroxy-terminated liquid isoprene rubber; hydroxy-terminated polybutadiene polyol; polytetramethylene ether glycol; poly(oxypropylene) glycol; polyethylene adipate glycol; polyethylene propylene adipate glycol; polybutylene adipate glycol; diethylene glycol initiated polycaprolactone; 1,4-butanediol initiated polycaprolactone; 1,6-hexanediol initiated polycaprolactone; trimethylol propane initiated polycaprolactone; neopentyl glycol initiated polycaprolactone; polytetramethylene ether glycol initiated polycaprolactone, and mixtures thereof.

15. A golf ball comprising a core, a cover, and an intermediate layer disposed therebetween, wherein a portion of the golf ball is formed of a composition comprising at least one water resistant polyurethane elastomer, wherein the water resistant polyurethane elastomer is a reaction product of at least one poly-isocyanate, at least one curing agent and at least one polyol, wherein the polyol is based on a hydrophobic backbone.

16. The golf ball of claim 15, wherein the cover has a thickness of from about 0.02 inch to about 0.35 inch, a hardness of at least about 40 Shore D, and a flexural modulus of at least about 500 psi.

17. The golf ball of claim 15, wherein the composition further comprises a polymer selected from the group consisting of polyurethane ionomers, polyurea ionomers, polyurethanes, polyureas, epoxy resins, or a combination thereof.

18. The golf ball of claim 17, wherein the polymer is present in an amount from about 90 percent to about 10 percent by weight of the composition.

19. The golf ball of claim 15, wherein the intermediate layer has a hardness of about 40 Shore A or greater and a flexural modulus of about 500 psi or greater.

20. The golf ball of claim 15, wherein the poly-isocyanate is selected from the group consisting of toluene diisocyanate; 4,4'-diphenylmethane diisocyanate; polymeric 4,4'-diphenylmethane diisocyanate; carbodiimide-modified diphenylmethane diisocyanate; 3,3'-dimethyldiphenyl-4,4'diisocyanate; naphthalene diisocyanate; para-phenylene diisocyanate; xylene diisocyanate; para-tetramethylxylene diisocyanate; meta-tetramethylxylene diisocyanate; ethylene diisocyanate; propylene-1,2-diisocyanate; tetramethylene-1,4-diisocyanate; cyclohexyl diisocyanate; 1,6-hexamethylene-diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanato-methylcyclohexane; isophorone diisocyanate; methyl cyclohexylene diisocyanate; triisocyanate of 1,6-hexamethylene-diisocyanate; triisocyanate of 2,2,4-trimethyl-1,6-hexane diisocyanate; triisocyanate of 2,4,4-trimethyl-1,6-hexane diisocyanate; 4,4'-dicyclohexylmethane diisocyanate; trimethyl-hexamethylene diisocyanate, and mixtures thereof.

* * * * *